US011611839B2

(12) United States Patent
Siddiq

(10) Patent No.: US 11,611,839 B2
(45) Date of Patent: Mar. 21, 2023

(54) OPTIMIZATION OF CONVOLUTION REVERBERATION

(71) Applicant: SQUARE ENIX CO., LTD., Tokyo (JP)

(72) Inventor: Sadjad Siddiq, Tokyo (JP)

(73) Assignee: SQUARE ENIX CO., LTD., Tokyo (JP)

( * ) Notice: Subject to any disclaimer, the term of this patent is extended or adjusted under 35 U.S.C. 154(b) by 0 days.

(21) Appl. No.: 17/447,032

(22) Filed: Sep. 7, 2021

(65) Prior Publication Data

US 2022/0078567 A1 Mar. 10, 2022

(30) Foreign Application Priority Data

Sep. 8, 2020 (JP) ..... JP2020-150585

(51) Int. Cl.
*H04R 3/00* (2006.01)
*G10K 15/08* (2006.01)
*H04R 29/00* (2006.01)

(52) U.S. Cl.
CPC ..... *H04R 29/00* (2013.01); *G10K 15/08* (2013.01); *H04R 3/00* (2013.01)

(58) Field of Classification Search
CPC . H04R 3/00; H04R 3/005; H04R 3/02; H04R 3/04; H04R 29/00; H04R 29/001; H04R 29/004; G10K 11/16; G10K 11/178; G10K 11/1781; G10K 15/08; G10L 21/00; G10L 21/02; G10L 21/0208; G10L 21/02082; H04M 9/08; H04M 9/082
See application file for complete search history.

(56) References Cited

U.S. PATENT DOCUMENTS 9,245,520 B2 * 1/2016 Neugebauer ..... G10K 15/12
2008/0069366 A1 * 3/2008 Soulodre ..... H04S 7/301 84/630
2013/0028432 A1 * 1/2013 Suzuki ..... H04M 9/082 381/66
2014/0355786 A1 * 12/2014 Betbeder ..... H03G 9/02 381/98

(Continued)

FOREIGN PATENT DOCUMENTS

JP 2010026044 A * 2/2010 ..... G10K 15/12
JP 6511775 B2 4/2019

*Primary Examiner* — Thang V Tran
(74) *Attorney, Agent, or Firm* — Dorsey & Whitney LLP

(57) ABSTRACT

A system for calculating reverberation, comprising a computer that receives a signal input; stores an impulse response signal; reads out the impulse response signal corresponding to the input signal; converts an input signal and an impulse response signal into an input signal in the frequency domain and an impulse response signal in the frequency domain; samples the input signal and in the frequency domain and the impulse response signal in the frequency domain to an input signal and an impulse response signal after sampling; sets one of values of signals included in the impulse response signal after sampling to zero to obtain an impulse response signal after zero-value processing; performs a convolution operation on the impulse response signal after zero-value processing to obtain a reverberant signal in the frequency domain; and converts the reverberant signal in the frequency domain into a reverberant signal in a time domain.

13 Claims, 4 Drawing Sheets

(56) References Cited

U.S. PATENT DOCUMENTS

| | | | | |
|---|---|---|---|---|
| 2016/0125871 | A1* | 5/2016 | Shirakihara | G10K 15/08<br>381/63 |
| 2020/0380943 | A1* | 12/2020 | Kim | G10K 11/16 |
| 2021/0304713 | A1* | 9/2021 | Yokota | G10H 1/125 |

* cited by examiner

[Fig. 1]
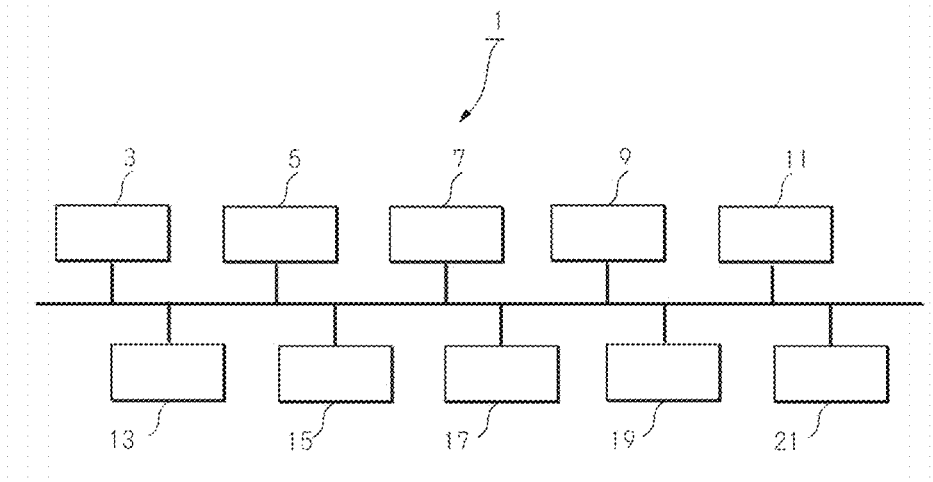
[Fig. 2]
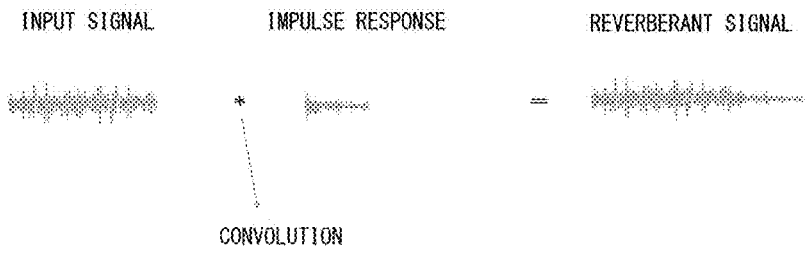
[Fig. 3]
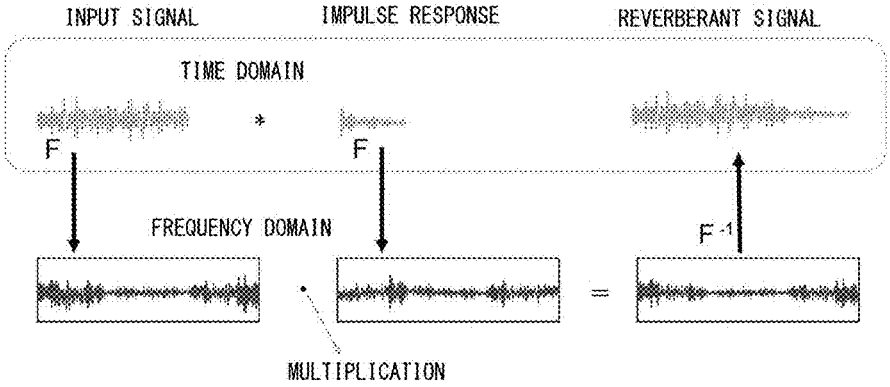

[Fig. 4]
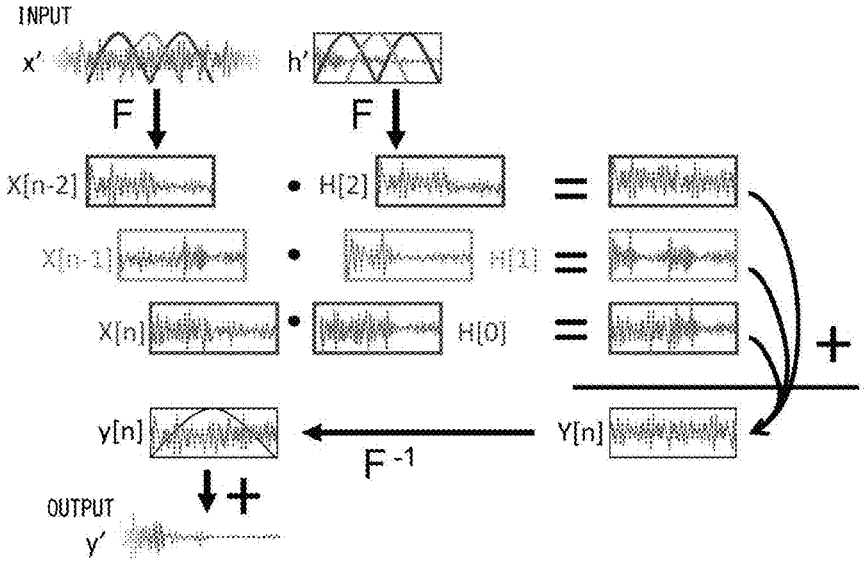
[Fig. 5]
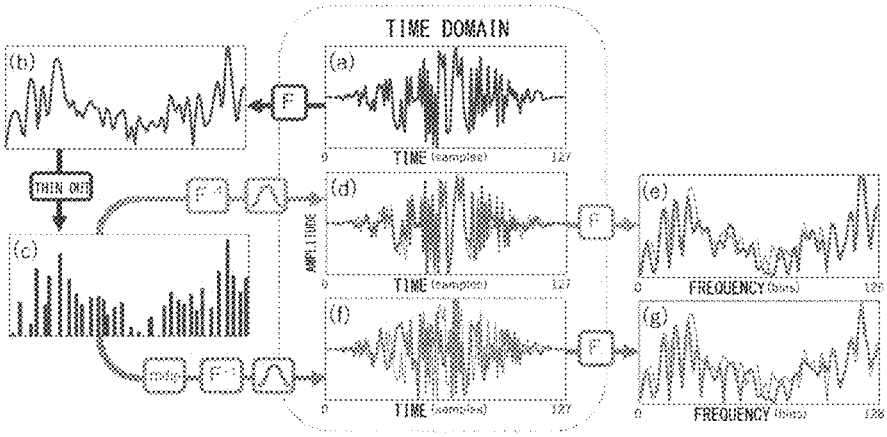

[Fig. 6]
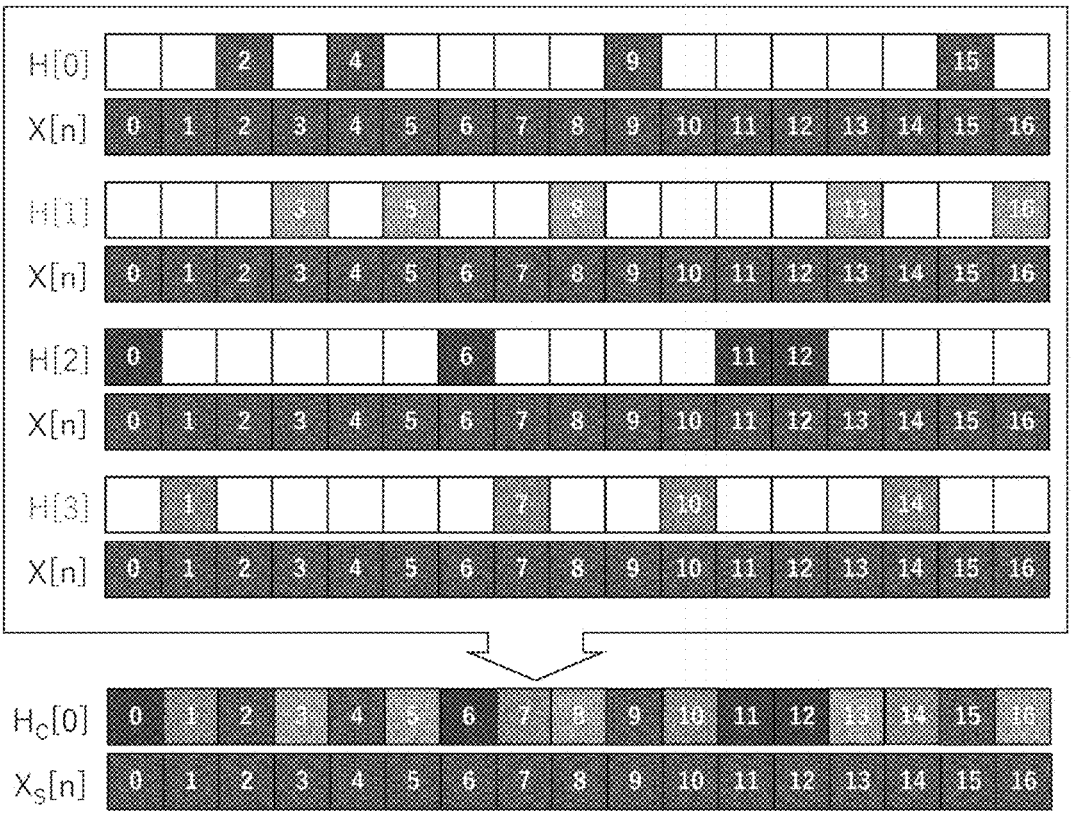

[Fig. 7]
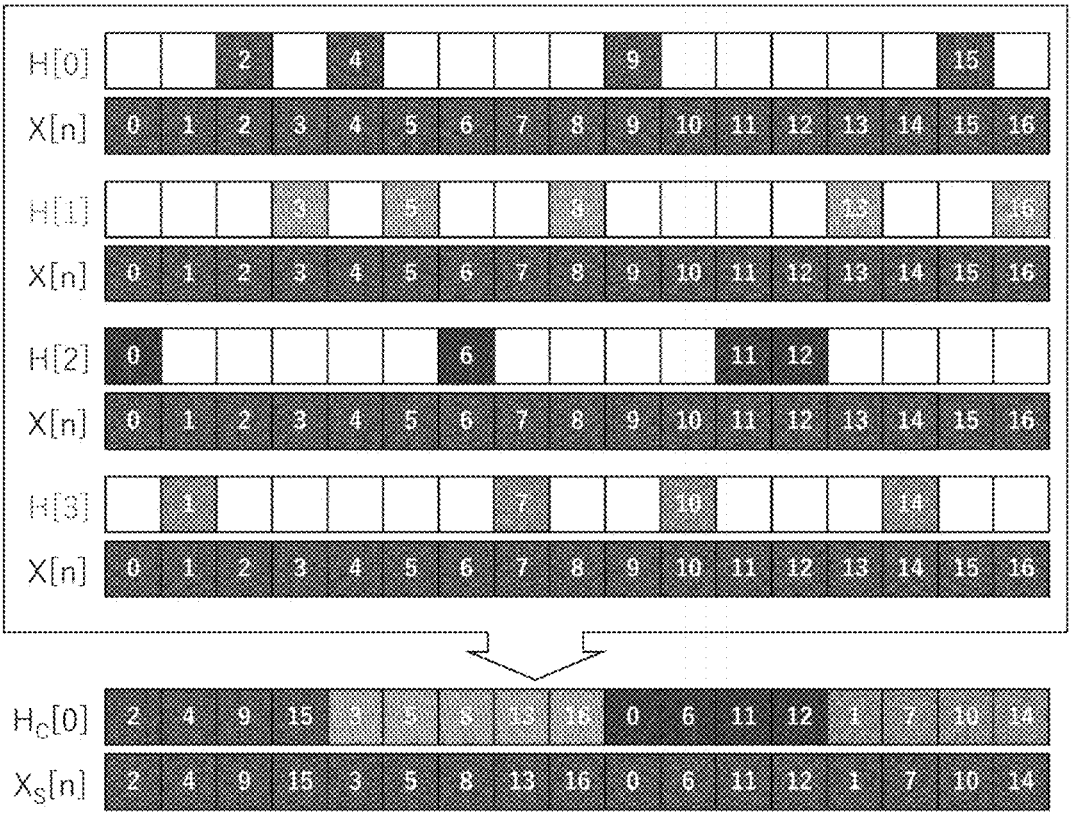
[Fig. 8]
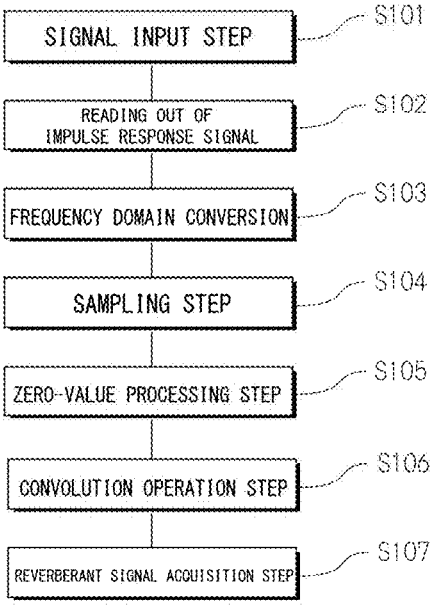

OPTIMIZATION OF CONVOLUTION REVERBERATION

CROSS REFERENCE TO RELATED APPLICATION(S)

This application claims priority to and the benefit of Japanese Patent Application No. JP2020-150585, filed Sep. 8, 2020, the disclosure of which is expressly incorporated herein by reference, in its entirety, for any purpose.

TECHNICAL FIELD

The present disclosure relates to a system for adding reverberant sound to an input acoustic signal. More specifically, the system for calculating reverberation can reduce the processing cost by converting an input signal and an impulse response signal into the frequency domain, convolving them, and discarding some information.

BACKGROUND

A reverberant sound adding apparatus convolves an impulse response into an acoustic signal and outputs the resulting signal. This reverberant sound adding apparatus convolves the impulse response into the acoustic signal by performing multiplication processing in the time domain in a convolution processor. Example of such systems may be found in Japanese Patent No. 6511775.

SUMMARY

In calculating reverberation, the convolution operation performed in the time domain requires a high processing cost. For this reason, the conventional acoustic adding apparatus has a problem of high processing cost.

Therefore, an object of the present specification is to provide, for example, a system for calculating reverberation capable of reducing the processing cost.

The present disclosure is basically based on the following findings. That is, the processing cost can be reduced by performing a convolution operation in the frequency domain. Further, the processing cost of the convolution operation can be reduced by sampling an impulse response before performing the convolution operation, and then setting one of the sampled values to zero.

A first disclosure described herein relates to a system for calculating reverberation. The system for calculating reverberation includes a signal input unit, an impulse response storage unit, an impulse response signal reading unit, a frequency domain conversion unit, a sampling unit, a zero-value processing unit, a convolution operation unit, and a reverberant signal acquisition unit. The system for calculating reverberation may further include one or both of an input signal storage unit and an order adjustment unit.

According to the present disclosure, basically, by performing the convolution operation in the frequency domain, and setting one of values of an impulse response sampled before the convolution operation is performed to zero, the processing cost of the convolution operation can be reduced. In this way, it is possible to provide a system for calculating reverberation capable of reducing the processing cost.

BRIEF DESCRIPTION OF DRAWINGS

FIG. 1 is a block diagram for explaining a system for calculating reverberation.

FIG. 2 is a conceptual diagram for explaining reverberation using convolution.

FIG. 3 is a conceptual diagram for explaining that a convolution operation is performed in the frequency domain to calculate a reverberant signal.

FIG. 4 illustrates a partitioned overlapping convolution operation.

FIG. 5 illustrates a verification example of signal deterioration.

FIG. 6 is a conceptual diagram for explaining that the order of an impulse response signal after zero-value processing is adjusted to obtain an impulse response signal after order adjustment.

FIG. 7 is a conceptual diagram for explaining that the order of an impulse response signal after zero-value processing is adjusted to obtain an impulse response signal after order adjustment.

FIG. 8 is a flowchart illustrating a method of computing reverberation using a computer.

DESCRIPTION OF EMBODIMENTS

Embodiments for carrying out the present disclosure will be described below with reference to the drawings. The present disclosure is not limited to the embodiments described below, and includes modifications of the following embodiments as appropriate within a scope obvious to those skilled in the art.

FIG. 1 is a block diagram for explaining a system for calculating reverberation. As illustrated in FIG. 1, a system 1 for calculating reverberation includes a signal input unit 3, an impulse response storage unit 5, an impulse response signal reading unit 7, a frequency domain conversion unit 9, a sampling unit 11, a zero-value processing unit 13, a convolution operation unit 15, and a reverberant signal acquisition unit 17. The system 1 for calculating reverberation may further include one or both of an input signal storage unit 19 and an order adjustment unit 21.

The above system 1 is a computer-based system. Each element may be implemented by a processor, by hardware, or by collaboration between hardware and software. The system itself for calculating reverberation is known. The reverberation is a sound signal that reproduces how an acoustic signal changes according to the environment where it is input.

The computer includes an input unit, an output unit, a control unit, a computation unit, and a storage unit, and these elements are connected by a bus or the like so that information can be exchanged therebetween. For example, the storage unit may store a program and/or various information. When specified information is input from the input unit, the control unit reads out a control program stored in the storage unit. Then, the control unit reads out information stored in the storage unit as appropriate and transmits it to the computation unit. The control unit also transmits the appropriately input information to the computation unit. The computation unit performs operation processing using various received information and stores the result in the storage unit. The control unit reads out the operation result stored in the storage unit and outputs it from the output unit. In this way, various processing is executed. Each unit or each means executes such various processing.

The system 1 according to the present disclosure may include a mobile terminal connected to the Internet or an intranet and a server connected to the Internet or the intranet. Of course, a single computer or mobile terminal may function as the apparatus according to the present disclosure, or a plurality of servers may be deployed. The system 1 according to the present disclosure may be a typical video game console. Examples of video game consoles are, for example, home video game machines, personal computers, and arcade video game machines.

FIG. 2 is a conceptual diagram for explaining reverberation using convolution. As illustrated in FIG. 2, by convolving an input signal with an impulse response signal, a reverberant sound signal can be obtained. An impulse response is the output of the system in response to the input of a short signal called an impulse. An impulse response signal is a signal indicating the impulse response.

FIG. 3 is a conceptual diagram for explaining that a convolution operation is performed in the frequency domain to calculate a reverberant signal. As illustrated in FIG. 3, the input signal and the impulse response signal are signals in the time domain. Each of the signals is subjected to frequency conversion (F: for example, Fourier transform) to obtain a signal in the frequency domain (for example, a function). Then, the convolution operation is performed by multiplying the signals in the frequency domain to obtain a signal in the frequency domain (reverberant sound signal). By inverse transforming the signal in the frequency domain ($F^{-1}$: for example, inverse Fourier transform), a reverberant sound signal in the time domain can be obtained.

On the other hand, as illustrated in FIG. 3, when the convolution operation is performed on an input signal (x'(t)) and an impulse response signal (h'(t)) which have been converted into the frequency domain as they are, the processing amount becomes enormous. Therefore, this system 1 performs a partitioned overlapping convolution operation.

FIG. 4 illustrates a partitioned overlapping convolution operation. In the example of FIG. 4, the impulse response signal (h') is divided into three overlapping blocks of length M which are converted to three complex spectra (H [0], H[1], H[2]) of length 2M. These complex spectra are multiplied with three complex spectra (X[n−2], X[n−1], X[n]) which are extracted from the input signal x'. The products are summed up, converted back to the time domain, and overlap-added to obtain an output signal y'.

The signal input unit 3 is an element for receiving the input signal (x'(t)). The input signal is an acoustic signal whose frequency and amplitude change with time. The input unit may function as the signal input unit 3. Alternatively, the acoustic signal may be stored in the storage unit, the acoustic signal may be read out, and the acoustic signal may be input into the system. In other words, the system may further include the input signal storage unit 19 for storing the input signal, and an input signal (x'(t)) read out from the input signal storage unit 19 may be used as the input signal (x'(t)).

The impulse response storage unit 5 is an element for storing the impulse response signal (h'(t)). For example, the storage unit of the computer functions as the impulse response storage unit 5. The impulse response signal (h'(t)) is a signal that reflects the amplitude characteristics of the impulse response in a specific environment Examples of impulse response signals include impulse response signals in narrow caves, impulse response signals in environment with a mountain nearby, and impulse response signals inside a metal dome. Thus, an impulse response signal corresponding to an input signal is, for example, an impulse response signal that reflects the environment related to the input signal (for example, gaming environment). For example, based on the input signal input to the system, the information about the environment related to the input signal is read out or and obtained by analysis, and the impulse response signal to be used for that environment can be read out from the impulse response storage unit 5.

The impulse response signal reading unit 7 is an element for reading out the impulse response signal (h'(t)) corresponding to the input signal (x'(t)) from the impulse response storage unit 5. For example, the storage unit and the program stored in the storage unit function as the impulse response signal reading unit 7. For example, when information indicating that a game character exists in a narrow cave is input to the system, an impulse response signal (h'(t)) in the narrow cave is read out corresponding to the position of the game character as an impulse response signal corresponding to the input signal (x'(t)). The read impulse response signal (h'(t)) is a signal that becomes a reverberant signal together with the input signal (x'(t)) and is also a signal corresponding to the input signal (x'(t)).

The frequency domain conversion unit 9 is an element for performing a frequency conversion operation (F) for converting the input signal (x'(t)) and the impulse response signal (h'(t)) into signals in the frequency domain to obtain an input signal (X(f)) in the frequency domain and an impulse response signal (H(f)) in the frequency domain. For example, the storage unit, the control unit, the computation unit, and the program(s) stored in the storage unit function as the frequency domain conversion unit 9. An example of the frequency conversion operation (F) is a fast Fourier transform (FFT). Examples of the program(s) include a program for performing frequency operation processing on predetermined input information. For example, the input signal (x'(t)) and the impulse response signal (h'(t)) can be read out from the storage unit, and accordingly, the control unit can cause the computation unit to perform the frequency conversion operation based on a command from the program. The input signal (X(f)) in the frequency domain and the impulse response signal (H(f)) in the frequency domain thus obtained can be stored in the storage unit.

The sampling unit 11 is an element for sampling the input signal (X(f)) in the frequency domain and the impulse response signal (H(f)) in the frequency domain to obtain an input signal after sampling (X[n]) and an impulse response signal after sampling (H[n]). For example, the storage unit, control unit, and computation unit of the computer, and the program(s) stored in the storage unit functions as the sampling unit 11. The input signal (X(f)) in the frequency domain and the impulse response signal (H(f)) in the frequency domain are, for example, continuous values. If such continuous values remain, the number of operations will be enormous. Therefore, the sampling unit 11 extracts only a predetermined number (for example, n) of values in the continuous function. Sampling can be performed in this way. The sampling may be to extract values at regular frequency intervals. Further, the points for the maximum value and the minimum value may be extracted.

The zero-value processing unit 13 is an element for setting one of the values of signals included in the impulse response signal after sampling (H[n]) to zero to obtain an impulse response signal after zero-value processing ($H_0$[n]). For example, the storage unit, control unit, and computation unit of the computer, and the program(s) stored in the storage unit functions as the zero-value processing unit 13.

Not all bins of the complex spectra of the impulse response need to be used. Bins whose amplitude is below a certain threshold can be discarded without compromising on output quality, since their contribution to the output signal is barely audible. Ideally this threshold should be based on the hearing threshold. To project the hearing threshold to a certain amplitude level in the impulse response, the system may take several other values into account, for example the frequency, the amplitude of the input, the amplitude of the impulse response and the playback volume. But even if all these values are known, it is not trivial to calculate an appropriate value if masking and other perceptual factors are also taken into account. Based on informal listening experiments the system may set this value to −60 dB, where 0 dB correspond to 1, the maximum amplitude of the waveforms the system process.

As illustrated in FIG. 5 described later, even when the phase of the impulse response signal after sampling (H[n]) is changed (lower of (c) in FIG. 5), the frequency component does not change so much ((e) and (g) in FIG. 5). Therefore, for the impulse response signal ($H_0[n]$), particularly the impulse response signal ($H_0[n]$) having non-zero bins, their phase $\varphi$ is $\varphi=\exp(\pi rj/2)$, where r is an integer randomly chosen from 0 or more and 3 or less. Then, they will result in, for example, $\varphi_1=1$, $\varphi_2=j$, $\varphi_3=-1$, $\varphi_4=-j$, and so on. By randomly changing the phases of the impulse response signal (H[n]) in this way, the number of multiplications of complex numbers can be significantly reduced. One example of the zero-value processing unit 13 randomly set one of the values of signals included in the impulse response signal after sampling (H[n]) to zero.

Another example of the zero-value processing unit 13 other than the above sets, to zero, signals having an amplitude (|H[n]|) of a predetermined value or less among the signals included in the impulse response signal after sampling (H[n]). Further another example of the zero-value processing unit 13 uses a window function to set, to zero, one of the values of signals included in the impulse response signal after sampling (H[n]). An example of the window function is the Hann window function. A preferable example of the zero-value processing unit 13 sets, to zero, values of 30% or more and 90% or less of the impulse response signal after sampling (H[n]). This ratio may be 40% or more and 90% or less, 50% or more and 90% or less, 70% or more and 90% or less, 30% or more and 80% or less, and 50% or more and 80% or less.

The convolution operation unit 15 is an element for performing a convolution operation on the impulse response signal after zero-value processing ($H_0[n]$) to obtain a reverberant signal (Y[n]) in the frequency domain. For example, the storage unit, control unit, and computation unit of the computer, and the program(s) stored in the storage unit functions as the convolution operation unit 15. For example, the input signal after sampling (X[n]) is read out from the storage unit, and the corresponding impulse response signal after zero-value processing ($H_0[n]$) is subjected to multiplication. An example of the convolution operation is multiplication of complex numbers. In this way, the convolution operation is performed to obtain the reverberant signal (Y[n]) in the frequency domain. The resulting reverberant signal (Y[n]) in the frequency domain is stored in the storage unit as appropriate. As mentioned above, the multiplication of complex numbers requires a large number of multiplications. On the other hand, since some values are set to zero by the zero-value processing unit 13, the number of multiplications can be reduced.

The reverberant signal acquisition unit 17 is an element for performing a time domain conversion operation ($F^{-1}$) for converting a reverberant signal (y[n]) in the frequency domain into a signal in the time domain to obtain a reverberant signal (y'(t)). For example, the storage unit, control unit, and computation unit of the computer, and the program(s) stored in the storage unit functions as the reverberant signal acquisition unit 17. An example of the time domain conversion operation ($F^{-1}$) is the inverse fast Fourier transform (iFFT). For example, the reverberant signal (y[n]) in the frequency domain can be read out from the storage unit, and accordingly, the control unit can cause the computation unit to perform the time domain conversion calculation ($F^{-1}$) based on a command from the program.

The reverberant signal acquisition unit 17 may set the value of a certain bin of the reverberant signal (y[n]) in the frequency domain to zero, and then may perform the time domain conversion operation ($F^{-1}$) for converting into a signal in the time domain on the reverberant signal in the frequency domain in which the value of the certain bin is set to zero to obtain the reverberant signal (y'(t)). By performing such processing, the processing amount of the time domain conversion operation can be reduced.

FIG. 5 illustrates a verification example of signal deterioration. When the white noise illustrated in (a) of FIG. 5 is subjected to the Fourier transform, a signal in the frequency domain is obtained (b). When this signal in the frequency domain is thinned out by sampling, a sparse spectrum is obtained (c). A zero-value processing operation is performed on this sparse spectrum by using the inverse Fourier transform and the Hann window function. Then, a signal in the time domain is obtained (d). Note that, in (d) of FIG. 5, the original white noise is also drawn with thin lines. As illustrated in (d), it can be seen that the original spectrum can be restored by the zero-value processing operation using the Hann window function. The signal of (d) was subjected to the Fourier transform to obtain an amplitude signal (e). This amplitude signal is also similar to the result of the Fourier transform of the original white noise. In other words, it was found that the original signal can be effectively restored by sampling and zero-value processing.

An order adjustment described later is also considered.

After the phase of the sparse spectrum (c) is randomized, the zero-value processing operation is performed on the randomized spectrum by the inverse Fourier transform and the Hann window function. Then, a signal in the time domain is obtained (f). In (f) of FIG. 5, the original white noise is also drawn with thin lines. As illustrated in (f), the signal in the time domain is not similar to the original white noise. On the other hand, the signal (f) in the time domain is converted into a signal in the frequency domain (g). Then, the signal in the frequency domain becomes similar to the Fourier-transformed signal of the original white noise. As a result, it can be said that the intensity information of the signal does not deteriorate even if the phase of the spectrum (c) is randomized (that is, even if the order adjustment processing is performed).

The order adjustment unit 21 is an element for adjusting the order of the impulse response signal after zero-value processing ($H_0[n]$) such that only those that require the convolution operation can be performed to obtain an impulse response signal after order adjustment ($H_C[0]$). In this case, the convolution operation unit 15 performs the convolution operation on the impulse response signal after order adjustment ($H_C[0]$).

FIG. 6 is a conceptual diagram for explaining that the order of impulse response signal after zero-value processing ($H_0[n]$) is adjusted to obtain the impulse response signal after order adjustment ($H_C[0]$). In the convolution operation, the operation of $H[i]\cdot X[n-i]$ is performed for all i, and the products are summed up. As described in FIG. 4, for example, each of the impulse response signals after zero-value processing ($H_0[n]=H[0], H[1], H[2], H[3]$) is multiplied with the input signal after sampling (X[n]). However, some impulse response signals after zero value processing ($H_0[n]$=H[0], H[1], H[2], H[3]) have bins of zero value. Therefore, it is not necessary to multiply all the impulse response signals after zero value processing with the input signal after sampling (X[n]). Therefore, as illustrated in FIG. 6, the order of the impulse response signal after zero-value processing ($H_0[n]$) is adjusted such that only those that require the convolution operation can be performed to obtain the impulse response signal after order adjustment ($H_C[0]$), so that the number of convolution operations can be significantly reduced. Specifically, in the example of FIG. 6, the convolution operation can be performed by simply preparing the impulse response signal after order adjustment ($H_C[0]$) and an input signal ($X_S[n]$) in the frequency domain corresponding to the impulse response signal ($H_C[0]$), multiplying these, and summing up the products.

FIG. 7 is a conceptual diagram for explaining that the order of impulse response signal after zero-value processing ($H_0[n]$) is adjusted to obtain the impulse response signal after order adjustment ($H_C[0]$). In the example of FIG. 7, the impulse response signal after order adjustment ($H_C[0]$) is adjusted for each of the blocks where H[0], H[1], H[2], and H[3] have any value, and the order of the blocks in the input signal ($X_S[n]$) in the frequency domain are also adjusted so as to correspond to the order of the adjusted impulse response signals after order adjustment ($H_C[0]$). In this case as well, the convolution operation can be performed by simply preparing the impulse response signal after order adjustment ($H_C[0]$) and an input signal ($X_S[n]$) in the frequency domain corresponding to the impulse response signal ($H_C[0]$), multiplying these, and summing up the products.

Another disclosure relates to a program for causing a computer (or processor) to function as the system 1 for calculating reverberation described above, and an information recording medium that is readable by a computer that stores the program. Each of the above-described units may be read as each means.

Still another disclosure relates to a method of computing reverberation using the above-described system 1.

FIG. 8 is a flowchart illustrating a method of computing reverberation using a computer.

As illustrated in FIG. 8, this method includes a signal input step (S101), an impulse response signal readout step (S102), a frequency domain conversion step (S103), a sampling step (S104), a zero-value processing step (S105), a convolution operation step (S106), and a reverberant signal acquisition step (S107).

In this method, the above-described system 1 including a computer or a processor performs the following processing.

An input signal (x'(t)) is received (S101).

An impulse response signal (h'(t)) corresponding to the input signal (x'(t)) is read out (S102).

A frequency conversion operation (F) is performed for converting the input signal (x'(t)) and the impulse response signal (h'(t)) into signals in the frequency domain to obtain an input signal (X(f)) in the frequency domain and an impulse response signal (H(f)) in the frequency domain (S103).

The input signal (X(f)) in the frequency domain and the impulse response signal (H(f)) in the frequency domain are sampled to obtain an input signal after sampling (X[n]) and an impulse response signal after sampling (H[n]) (S104).

One of the values of signals included in the impulse response signal after sampling (H[n]) is set to zero to obtain an impulse response signal after zero-value processing ($H_0[n]$) (S105).

A convolution operation is performed on the impulse response signal after zero-value processing ($H_0[n]$) to obtain a reverberant signal (Y[n]) in the frequency domain (S106).

A time domain conversion operation ($F^{-1}$) is performed for converting a reverberant signal (y[n]) in the frequency domain into a signal in the time domain to obtain a reverberant signal (y'(t)) (S107).

This method may further include a step of adjusting the order of the impulse response signal after zero-value processing ($H_0[n]$) such that only those that require the convolution operation can be performed to obtain an impulse response signal after order adjustment ($H_C[0]$).

The present disclosure is available in the field of information processing, especially in the amusement industry.

The invention claimed is:

1. A system for calculating reverberation, comprising a computer configured to:

receive a first input signal (x'(t)) at a signal input;

store a first impulse response signal (h'(t)) in an impulse response storage;

read out the first impulse response signal (h'(t)) from the impulse response storage;

convert, using frequency conversion operation (F), the first input signal (x'(t)) and the first impulse response signal (h'(t)) into a second input signal (X(f)) in the frequency domain and a second impulse response signal (H(f)) in the frequency domain;

sample the second input signal (X(f)) in the frequency domain and the second impulse response signal (H(f)) in the frequency domain to obtain a third input signal after sampling (X[n]) and a third impulse response signal after sampling (H[n]);

set one of values of signals included in the third impulse response signal after sampling (H[n]) to zero to obtain a fourth impulse response signal after zero-value processing ($H_0[n]$);

perform a convolution operation on the fourth impulse response signal after zero-value processing ($H_0[n]$) to obtain a reverberant signal (Y[n]) in the frequency domain; and convert, using a time domain conversion operation ($F^{-1}$), the reverberant signal (y[n]) in the frequency domain into a reverberant signal (y'(t)) in a time domain.

2. The system according to claim 1, wherein the computer is further configured to store the first input signal in an input signal storage, and wherein the computer is configured to read out the first input signal (x'(t)) from the input signal storage.

3. The system according to claim 1, wherein the computer is further configured to adjust an order of the fourth impulse response signals after zero-value processing ($H_0[n]$) to obtain a fifth impulse response signal after order adjustment ($H_C[0]$), and wherein the computer is configured to perform the convolution operation on the fifth impulse response signal after order adjustment ($H_C[0]$).

4. The system according to claim 1, wherein the frequency conversion operation (F) is a fast Fourier transform (FFT), and the time domain conversion operation ($F^{-1}$) is an inverse fast Fourier transform (iFFT).

5. The system according to claim 2, wherein the frequency conversion operation (F) is a fast Fourier transform (FFT) and the time domain conversion operation ($F^{-1}$) is an inverse fast Fourier transform (iFFT).

6. The system according to claim 1, wherein the computer is configured to use a window function to set one of values of signals included in the third impulse response signal after sampling (H[n]) to zero.

7. The system according to claim 2, wherein the computer is configured to use a window function to set one of values of signals included in the third impulse response signal after sampling (H[n]) to zero.

8. The system according to claim 1, wherein the computer is configured to set values of 30% or more and 90% or less of the impulse response signal after sampling (H[n]) to zero.

9. The system according to claim 2, wherein the computer is configured to set values of 30% or more and 90% or less of the impulse response signal after sampling (H[n]) to zero.

10. The system according to claim 1, wherein the convolution operation is a multiplication of complex numbers.

11. The system according to claim 2, wherein the conversion operation is a multiplication of complex number.

12. A non-transitory information recording medium storing a program configured to cause a computer to perform functions for calculating reverberation, the functions comprising:

receiving a first input signal (x'(t));

storing a first impulse response signal (h'(t));

reading out the stored first impulse response signal (h'(t));

converting the first input signal (x'(t)) and the first impulse response signal (h'(t)) into a second input signal (X(f)) in the frequency domain and a second impulse response signal (H(f)) in the frequency domain;

sampling the second input signal (X(f)) in the frequency domain and the second impulse response signal (H(f)) in the frequency domain to obtain a third input signal after sampling (X[n]) and a third impulse response signal after sampling (H[n]);

setting one of values of signals included in the third impulse response signal after sampling (H[n]) to zero to obtain a fourth impulse response signal after zero-value processing ($H_0$[n]);

performing a convolution operation on the fourth impulse response signal after zero-value processing ($H_0$[n]) to obtain a reverberant signal (Y[n]) in the frequency domain; and converting the reverberant signal (y[n]) in the frequency domain into a reverberant signal (y'(t)) in a time domain.

13. A method of computing reverberation using a computer, the method comprising:

receiving a first input signal (x'(t));

reading out a first impulse response signal (h'(t)) corresponding to the first input signal (x'(t));

converting the first input signal (x'(t)) and the first impulse response signal (h'(t)) into a second input signal (X(f)) in the frequency domain and a second impulse response signal (H(f)) in the frequency domain;

sampling the second input signal (X(f)) in the frequency domain and the second impulse response signal (H(f)) in the frequency domain to obtain a third input signal after sampling (X[n]) and a third impulse response signal after sampling (H[n]);

setting one of values of signals included in the third impulse response signal after sampling (H[n]) to zero to obtain fourth an impulse response signal after zero-value processing ($H_0$[n]);

performing a convolution operation on the fourth impulse response signal after zero-value processing ($H_0$[n]) to obtain a reverberant signal (Y[n]) in the frequency domain; and converting the reverberant signal (y[n]) in the frequency domain into a reverberant signal (y'(t)) in a time domain.

* * * * *